United States Patent [19]

Watkinson

[11] 3,976,163

[45] Aug. 24, 1976

[54] STORAGE-STAND

[76] Inventor: David E. Watkinson, 1809 E. River Drive, Margate, Fla. 33063

[22] Filed: Dec. 29, 1975

[21] Appl. No.: 644,433

[52] U.S. Cl. ..... 182/20; 182/129; 182/151; 182/152; 190/12 R; 108/35

[51] Int. Cl.[2] ..... A45F 3/00; A47B 41/04; E04G 1/28

[58] Field of Search ..... 182/20, 21, 27, 28, 182/33, 35, 129, 222, 223, 151, 152; 190/11, 12 R, 12 A; 108/33, 34, 35, 36

[56] References Cited

UNITED STATES PATENTS

| | | | |
|---|---|---|---|
| 1,578,248 | 3/1926 | Ackerman | 190/12 R |
| 2,259,145 | 10/1941 | Waldo | 190/11 |
| 2,693,258 | 11/1954 | Fleisch | 108/36 |
| 2,715,053 | 8/1955 | Wiegel | 190/12 R |
| 2,775,499 | 12/1956 | Gleitsman | 182/35 |
| 3,016,104 | 1/1962 | Johnson | 182/129 |
| 3,208,807 | 9/1965 | Becker | 190/12 R |
| 3,407,899 | 10/1968 | Delafrange | 182/20 |

*Primary Examiner*—Reinaldo P. Machado
*Attorney, Agent, or Firm*—Oltman and Flynn

[57] ABSTRACT

A storage-stand having a deck and a pair of legs pivotally attached to opposite ends of the deck and movable between folded positions inwardly of the ends of the deck and parallel to the deck and extended positions at an obtuse angle to the deck. When the legs are extended they spread obtusely outward from the deck. The legs and the deck are hollow and have means within them for retaining tools for storage.

8 Claims, 5 Drawing Figures

STORAGE-STAND

BACKGROUND OF THE INVENTION

Foldable storage devices have been proposed previously; for example, in U.S. Pat. No. 2,715,053 — Weigel. Such storage devices have not been designed to hold the weight of a person standing thereon.

SUMMARY OF THE INVENTION

The present invention provides a storage-stand which is specifically designed so that a person may stand on it and use the device as a ladder. The storage-stand is hollow and tools may be stored in it. Thus, a workman can utilize the stand in connection with carpentry, painting, wallpapering and other purposes. The storage-stand has a deck and foldable legs which are particularly designed to hold relatively heavy loads. When the legs are in their folded positions, they lie flat against and parallel to the deck. When the legs are extended, they extend obtusely outward from the deck and are well braced so as to provide a rigid stand structure. The stand preferably has clamps inside it for receiving tools for storage purposes. Side members of the deck and legs extend at an acute angle to planar members thereof in order to enable the legs to extend obtusely relative to the deck when the legs are in the extended positions so that the legs cannot collapse when a person stands on the unit.

Accordingly, it is an object of the present invention to provide an improved storage-stand capable of holding the load of a person standing on the device.

Another object of the invention is to provide a storage-stand which folds into a convenient collapsed condition.

A further object of the invention is to provide a storage-stand capable of storing a variety of tools.

Another object of the invention is to provide an improved construction for a storage-stand enabling the legs of the stand to extend obtusely relative to a deck thereof for rigidizing the unit.

Further objects and advantages of this invention will be apparent from the following detailed description of a presentlypreferred embodiment thereof, which is shown in the accompanying drawings.

Figure 1:
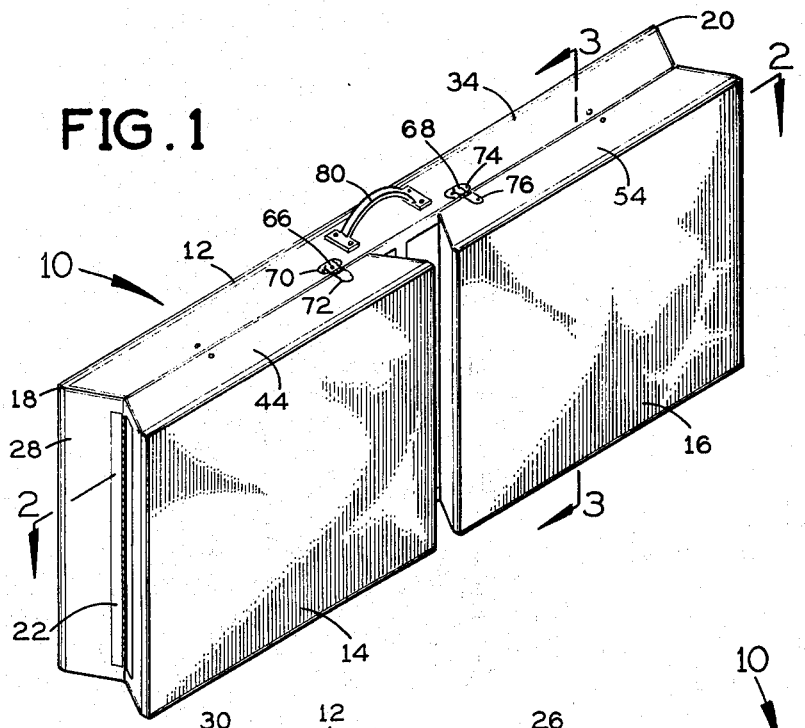
FIG. 1 is a perspective view of a storage-stand in accordance with a preferred embodiment of the invention.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

The storage-stand 10 includes a deck 12 and two legs 14, 16. The legs 14, 16 are pivotally affixed respectively to opposite ends 18, 20 of the deck 12 by hinges 22, 24. The hinges may be piano-type hinges which extend over most of the width of the deck and legs.

The deck 12 includes a planar member 26 and four side members 28, 30, 32 and 34 affixed thereto and forming a transverse rim around the perimeter of the planar member 26.

The leg 14 includes a planar member 36 and four side members 38, 40, 42 and 44 affixed thereto and forming a transverse rim around the perimeter of planar member 36. Similarly, leg 16 includes a planar member 46 and four side members 48, 50, 52, and 54 affixed thereto forming a transverse rim around the perimeter of planar member 46.

Figure 3:
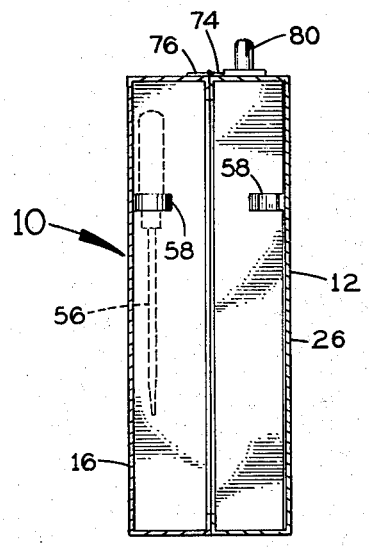
FIG. 3 is a cross-sectional view taken along line 3—3 of FIG. 1 and looking in the direction of the arrows.
Figure 4:
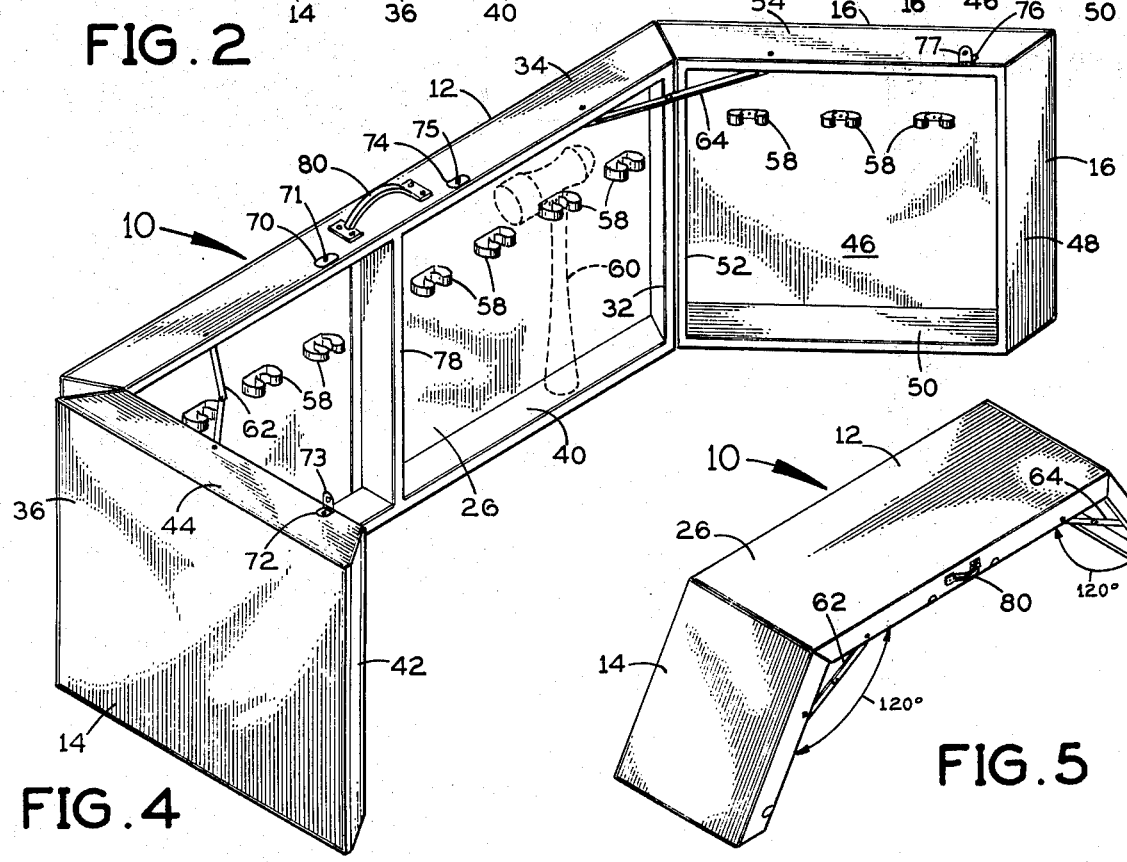
FIG. 4 is a perspective view of the storage-stand showing the legs thereof partially unfolded and revealing the storage space inside the unit.

Thus, the deck 12 and the leg members 14 and 16 are each hollow and provide space for storage of tools such as the tools 56 and 60, shown in dashed lines in FIGS. 3 and 4. Spring-clamps 58 having a U-shape, or other suitable clamp means, are affixed to the planar members 26, 36 and 46 so as to be located inside the interior of the deck and legs. The tools 56 and 60, as well as other tools as desired, are retained in a clamp 58 when not in use.

Side members 28 and 38 are located opposite each other at the end 18 of deck 12. Side members 32 and 52 are located opposite each other at the end 20 of deck 12. Side members 28 and 32 each form an angle of about 60 degrees with the corresponding planar member 26 of deck 12. Side members 38 and 42 each form an angle of 60 degrees with the corresponding planar member 36 of leg 14. Side members 48 and 52 each form an angle of 60 degrees with the corresponding planar member 46 of leg 16.

Figure 2:
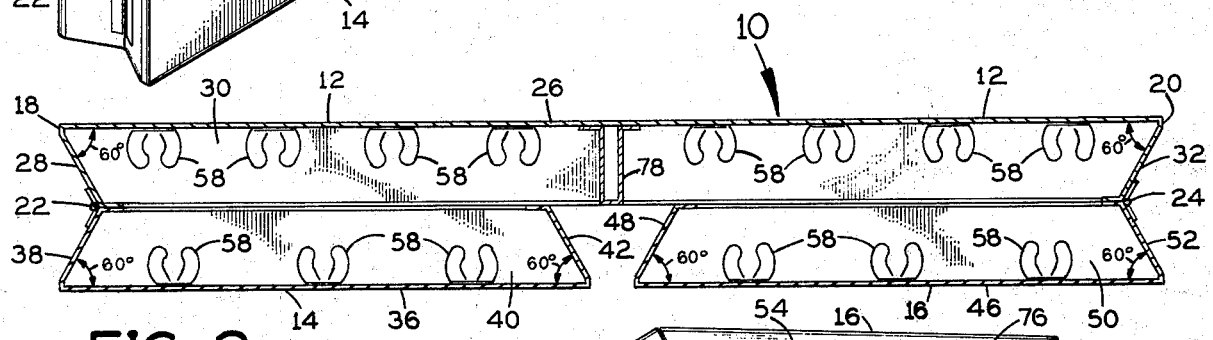
FIG. 2 is a sectional view taken along line 2—2 of FIG. 1 and looking in the direction of the arrows.
Figure 5:
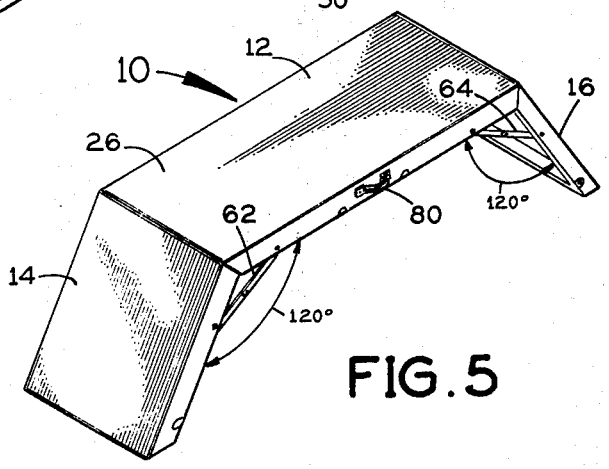
FIG. 5 is a perspective view showing the storage-stand in an unfolded condition with the legs fully extended such that a person can stand on the unit.

The legs 14 and 16 each have a folded position lying inwardly of the ends 18 and 20 and parallel to the deck 12 as shown in FIG. 2. The legs 14 and 16 also have an extended position wherein they are unfolded as shown in FIG. 5. In the extended positions of the legs 14 and 16, they each extend at an angle of 120 degrees relative to the deck 26. In the extended positions of the legs 14 and 16, side member 38 abuts against side member 28 and side member 52 abuts against side member 32 to provide a rigid stand wherein the legs are spread obtusely outward from the deck. Thus, a person can stand on the deck in the extended condition of the storage-stand as shown in FIG. 5, and the legs 14 and 16 will not collapse.

In order to further brace the legs, foldable braces 62 and 64 are provided. These foldable braces each have a pair of members pivoted at the middle of the brace and connected respectively to the deck 12 and one of the legs 14 and 16. Thus, the foldable braces are operatively connected between the deck and each of the legs for bracing the legs in the extended positions thereof.

Since side members 42 and 48 extend at an angle of 60 degrees relative to the corresponding deck members 36 and 46, the side members 42 and 48 rest flat on the ground when the legs are in the extended positions.

Latches 66 and 68 are provided for retaining the legs 14 and 16 in the folded positions thereof. Latch 66 includes complementary members 70 and 72 mounted respectively on deck 12 and leg 14 so as to oppose each other when the leg 14 is in the folded position. Latch 68 includes complemetary members 74 and 76 mounted respectively on the deck 12 and the leg 16 so as to oppose each other when the leg 16 is in the folded position. Latch members 72 and 76 have apertured pivotal portions 73 and 77 adapted to snap onto protrusions 71,75.

A dividing brace 78 is mounted within deck 12 and serves to further brace the deck. A handle 80 is mounted on side member 34 of deck 12 to enable the storage-stand to be carried when the legs are in the folded and latched positions.

Thus, the storage-stand serves multiple functions and is particularly useful as a storage place for a workman's tools, as a table for receiving materials which the workman is using, and as a ladder on which the workman may stand when necessary.

I claim:

1. In a storage-stand comprising a deck having opposite ends and first and second legs pivotally affixed respectively to said opposite ends of said deck, said deck and said legs each including a planar member and side members affixed thereto forming a transverse rim around the perimeter of said planar member, the improvement wherein:

opposed side members of said deck and each of said legs are located opposite each other at said opposite ends;

said opposed side members each form an acute angle with the corresponding planar member to which they are affixed; and said legs each having a folded position lying inwardly of said ends and parallel to said deck and an extended position at an obtuse angle to said deck wherein said opposed side members abut each other respectively to provide a rigid stand wherein said legs spread obtusely outward from said deck.

2. The storage-stand as claimed in claim 1 including: foldable bracing means operatively connected between said deck and each of said legs for bracing said legs in said extended positions thereof.

3. The storage-stand as claimed in claim 2 including: a plurality of clamp means affixed to said planar members inside said rims for retaining tools for storage.

4. The storage-stand as claimed in claim 3 in which: further side members of said legs at the ends thereof opposite said opposed side members form an acute angle with the corresponding planar members of said legs so as to rest flat on the ground when said legs are in said extended positions thereof.

5. The storage-stand as claimed in claim 4 including: latch means having complementary members affixed to said deck and said legs for latching said legs in said folded positions thereof.

6. The storage-stand as claimed in claim 1 wherein: said legs each pivot through an angle of about 120 degrees between said folded position and said extended position.

7. The storage-stand as claimed in claim 6 wherein: the acute angle formed between each of said opposed side members and said corresponding planar member is approximately 60°.

8. The storage-stand as claimed in claim 7 wherein: the acute angle formed between each of said further side members and said corresponding planar member is approximately 60°.

* * * * *